United States Patent [19]

Sheffield et al.

[11] 4,330,043

[45] May 18, 1982

[54] KEYSEAT WIPER

[75] Inventors: Marion C. Sheffield; Paul H. Dalier, both of Laurel, Miss.

[73] Assignee: Drill Services, Inc., Laurel, Miss.

[21] Appl. No.: 199,556

[22] Filed: Oct. 22, 1980

[51] Int. Cl.[3] ..... E21B 7/28; E21B 7/04

[52] U.S. Cl. ..... 175/406; 175/325; 308/4 A

[58] Field of Search ..... 175/406, 344, 320, 323, 175/325; 308/4 A

[56] References Cited

U.S. PATENT DOCUMENTS

| | | | |
|---|---|---|---|
| 2,079,449 | 5/1937 | Haldeman | 308/4 A |
| 2,168,707 | 8/1939 | Haldeman | 308/4 A |
| 2,904,313 | 9/1959 | Wisenbaker | 175/410 |
| 3,420,323 | 1/1969 | Owens | 175/323 |
| 4,102,552 | 7/1978 | Kellner | 175/325 |

*Primary Examiner*—Stephen J. Novosad
*Assistant Examiner*—Joseph Falk
*Attorney, Agent, or Firm*—Howard H. Darbo

[57] ABSTRACT

A keyseat wiper or reamer for enlarging keyseats which are often formed in drilling bores during well drilling operations. The wiper comprises a generally cylindrical body including a cylindrical middle guard portion which has a greater cross-sectional diameter than the greatest diameter of the cutting elements of the tool, the middle portion being free of any cutting elements. Cutting elements extend in a tapered manner from the middle portion to opposed locations toward the ends of the wiper. Because the middle guard portion does not carry cutting elements and is the largest diameter portion of the keyseat wiper, the keyseat wiper will cut only when the hole through which it is passing is of diameter smaller than that of the middle guard portion or when the well bore has a curve or dogleg.

7 Claims, 8 Drawing Figures

10
2.
2.
12
14
12

10
12

10
12
4.
4.
16

18
16
10
12

KEYSEAT WIPER

BACKGROUND OF THE INVENTION

This invention relates to well boring apparatus, and in particular to a keyseat wiper or reamer which eliminates or reduces troublesome curves or doglegs occurring in the drilled bore.

During the boring of a drilled well, and in particular oil and gas wells where many strata of rock are encountered, slots are often formed in the well bore during the drilling operation or as the string of drill pipe is withdrawn from the well. Because the drill pipe exerts tremendous force on a curved wall of the bore, the pipe tends to carve a groove into the wall, known as a "keyseat". Since the drill pipe is typically of smaller diameter than the diameter of the drill bit and of the drill collar or collars, removal of the pipe when a keyseat has been formed often causes a drill collar or the drill bit to lodge in the keyseat. At best, efforts to remove the lodged collar or drill bit cause a delay in the drilling operation or a costly process of fishing for the lodged bit.

The prior art has recognized the inherent problems of keyseats, and has developed many different types of tools for eliminating keyseats. For example, U.S. Pat. No. 2,904,313 discloses a reamer for a keyseat which comprises a plurality of cutting elements welded to the reamer body in a spiral fashion. The cutting elements include hardened or formed edges for reaming the keyseat.

Another prior art keyseat reamer is disclosed in U.S. Pat. No. 3,420,323. The reamer comprises a series of cutting elements attached either axially or spirally to the cylindrical body of the reaming tool. The cutting elements comprise outstanding ribs which are dressed with a hardened cutting material.

One problem with prior art keyseat reaming tools is strength. Those tools in which the keyseat reamer is merely a sleeve fitted on a portion of the drill pipe are prone to breakage. Also, because the cutting elements of the prior art extend beyond the outer diameter of the drill pipe, if the keyseat reamer comes into contact with the metal casing for the well, the reamer can cut into the casing, weakening the casing and creating the danger of a "blowout" in wells which are subjected to high pressure.

SUMMARY OF THE INVENTION

The invention overcomes the deficiencies of the prior art in a simple, yet effective manner. Like the prior art, the invention has a generally cylindrical body, means to connect the body at its opposite ends to a string of drill pipe, and a plurality of cutting elements spaced apart on the body. However, the key seat wiper of the invention also includes a middle guard portion which has a greater cross-sectional diameter than the outside diameter of the body, the guard portion being free of cutting elements, so that if the keyseat wiper comes into contact with the metal well casing, the guard portion of the tool prevents the cutting of, and consequent damage to, the casing.

The cutting elements of the invention are tapered between the guard portion and the respective ends of the tool. The taper of the cutting elements preferably is constant, or it may be of increasing or decreasing inclination so long as the height of the cutting elements above the cylindrical body of the keyseat wiper never extends beyond the outer diameter of the guard portion thereof.

The cutting elements are located at both ends of the tool to effect cutting by the keyseat wiper during both forward and withdrawal movements of the pipe drill string. The cutting elements may comprise tapered ribs circumferentially spaced about the body of the keyseat wiper, or may be spirally formed. In addition, if the keyseat wiper is to be used in connection with a drill string which is raised and lowered in the bore without rotation to eliminate a keyseat, the cutting ribs may be longitudinally spaced on the cylindrical body rather than circumferentially in order to cut in the up-down directions with or without rotation.

The surface of the middle guard portion may be smooth or, in order to allow bypassage of drilling fluid, this portion of the tool may also comprise circumferentially spaced but non-cutting ribs to form longitudinal channels between them.

BRIEF DESCRIPTION OF THE DRAWINGS

The invention is illustrated in greater detail in the drawings, in which.

DESCRIPTION OF EXAMPLES EMBODYING BEST MODE OF THE INVENTION

Figures 1, 2, 3, 4:
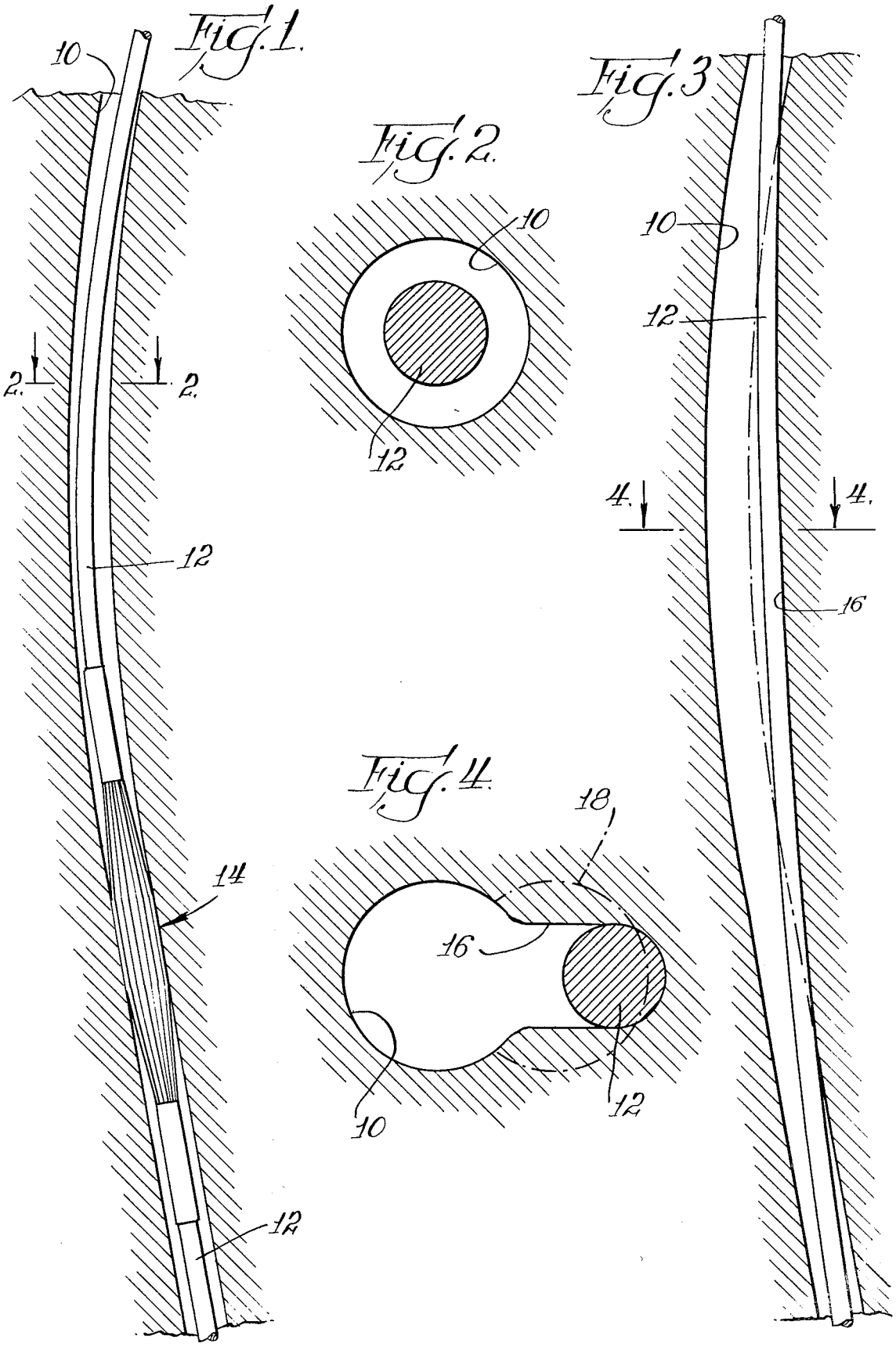
FIG. 1 is a sectional illustration of a portion of a drill bore including a string of drill pipe and a keyseat wiper according to the invention.
FIG. 2 is an enlarged cross-sectional illustration taken at line 2—2 of FIG. 1.
FIG. 3 is a cross-sectional illustration of a portion of a drill bore and portion of a string of drill pipe which has formed a keyseat in the wall of the drill bore.
FIG. 4 is an enlarged cross-sectional illustration taken along line 4—4 of FIG. 3.

Turning to the drawings, FIG. 1 illustrates with some degree of exaggeration, a portion of the bore 10 of a well which is curved at a slight angle, known as a "dogleg". A portion of a string of drill pipe 12 passes through the bore 10, and has a keyseat wiper 14 mounted between succeeding sections of the drill pipe 12. Although not illustrated, as is conventional the drill string incorporates one or more drill collars and terminates at its lower end at a drill bit. The upper end of the drill pipe is attached to suitable machinery to rotate the drill pipe for drilling and to remove the drill pipe from and insert it into the bore 10.

FIG. 3 illustrates the common condition encountered in the bore 10 when a dogleg is formed. As illustrated in greater detail in FIG. 4, during removal of the drill pipe or during the drilling operation, the tremendous force exerted by the string of drill pipe 12 against the curved wall of the bore 10 forms a keyseat 16 as shown. Since the diameter of the drill collars and of the drill bit (not illustrated) is greater than the diameter of the drill pipe 12, often during removal of the drill pipe from the bore 10, the collar and/or drill bit becomes lodged in the keyseat 16. To avoid or correct this condition, the keyseat wiper 14 is used to ream out the keyseat 16 to a size sufficient to allow passage of the collar and drill bit. As illustrated in phantom in FIG. 4, the keyseat wiper 14 enlarges the keyseat to the extent shown at bore lines 18 to permit passage of the drilling assembly.

Figure 5:
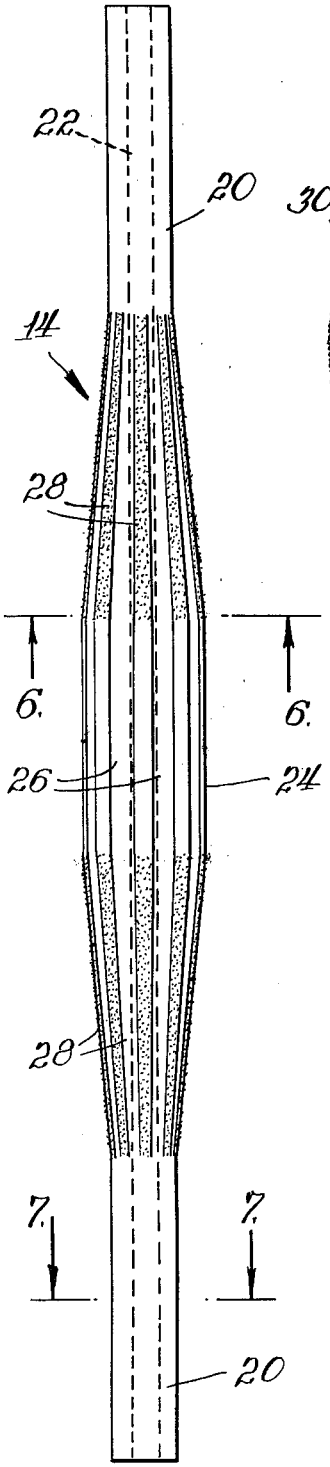
FIG. 5 is one embodiment of a keyseat wiper according to the invention.
Figure 6:
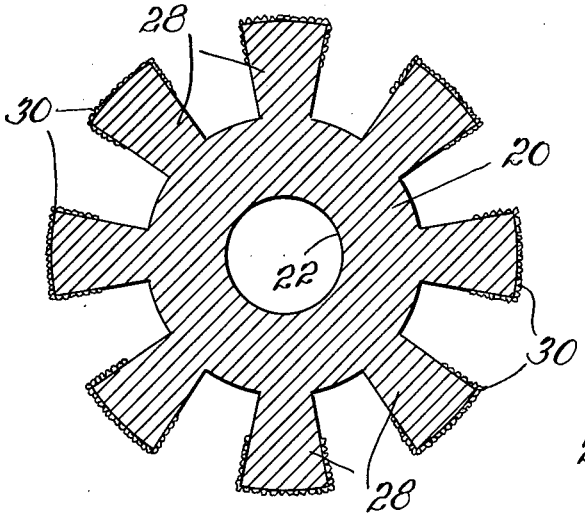
FIG. 6 is an enlarged cross-sectional illustration of the keyseat wiper of FIG. 5 taken along line 6—6.
Figure 7:
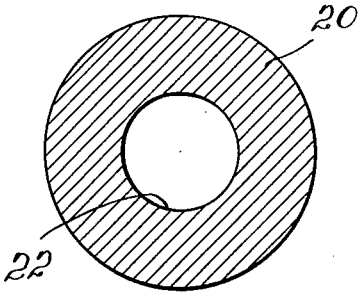
FIG. 7 is an enlarged cross-sectional illustration of the keyseat wiper of FIG. 5 taken along line 7—7.

One embodiment of the keyseat wiper according to the invention is shown in detail in FIGS. 5 through 7. As illustrated, the keyseat wiper 14 comprises a generally cylindrical body 20 which, if desired, may include a central bore 22 therethrough the end portions of which may eventually be machined as necessary for coupling of the tool with the drill pipe. A plurality of circumferentially spaced longitudinal ribs 28 extend the length of the wiper, except for the end coupling portions. As shown, the outer edges of the ribs form a cylindrical middle portion 24 and two tapered portions each extending toward an end of the tool from the middle portion. The ribs 28 may be integral portions of the keyseat wiper formed by cutting longitudinal channels 26 in a blank shaped with the middle and tapered portions or the ribs may be welded or otherwise affixed to the cylindrical body 20.

In accordance with the invention, the ribs comprising the tapered portions of the tool are cutting elements while the ribs forming the middle portion perform no cutting function. As is best shown in FIG. 6 each of the tapered ribs 28 is dressed with a coarse cutting surface 30 of a hard material, such as tungsten carbide, laid on the tops and adjacent portions of the sides of the ribs. If desired, non-cutting material may be laid on the top edges of the ribs forming the middle guard portion of the tool. If the metal forming the keyseat wiper is selected for the purpose, the tapered ribs 28 may be heat-treated or otherwise prepared to directly form cutting surfaces.

From the foregoing, it will be understood that the outside diameter of the middle portion of the keyseat wiper is sufficiently greater than the maximum outside diameter of the tapered portions of the cutting elements that the middle portion serves as a guard to prevent engagement of the cutting elements with the well casing without interfering with the reaming action of the tapered cutting portions of the tool as the drill string is carrying the keyseat wiper in either downward or upward direction within the bore hole.

Figure 8:
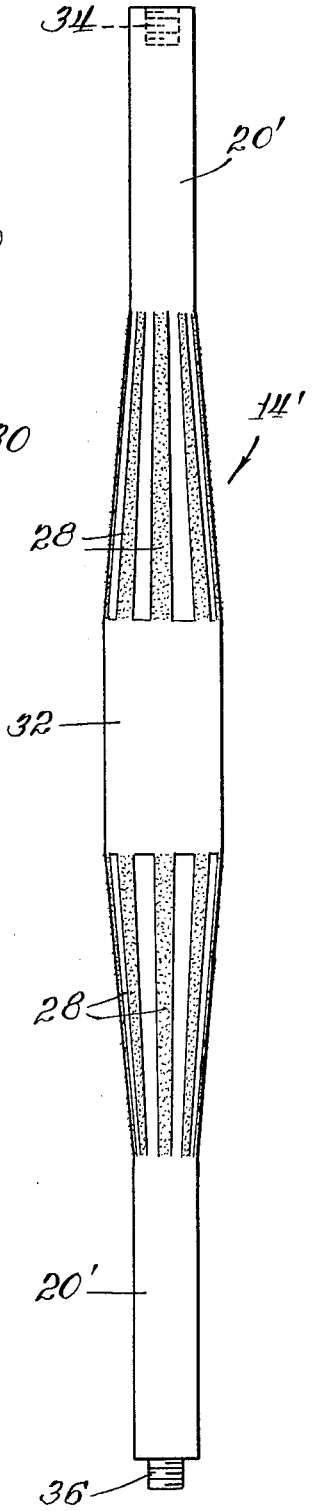
FIG. 8 is an elevational illustration of an alternative embodiment of the keyseat wiper according to the invention.

FIG. 8 illustrates an alternative embodiment of the invention in which the keyseat wiper 14' includes a solid middle guard portion 32 rather than the grooved cylindrical middle portion 24 illustrated in FIG. 5. The cutting elements 28 are formed in the same manner as the cutting elements 28 of FIGS. 5 and 6, and a cross-section of FIG. 8 taken in the location 6—6 of FIG. 5 would appear the same as that illustrated in FIG. 6. The keyseat wiper 14' of FIG. 8 normally would be employed where it is unnecessary to include longitudinal channels along the face of the middle guard portion of the tool.

Also illustrated in FIG. 8, the cylindrical body 20' of the keyseat wiper 14' is solid. One end of the body includes a female-threaded connector 34 while the other end includes a male-threaded connector plug 36. The connectors 34 and 36 engage like connectors in the drill pipe (not illustrated) in a conventional manner. Other means of connection and types of connectors may be employed as well, and form no part of the present invention.

The keyseat wiper according to the invention is used in a conventional manner. As illustrated in FIG. 1, the keyseat wiper 14 is inserted in the drill string between succeeding sections of the drill pipe 12. Then, as a dogleg is formed in the bore 10, the keyseat wiper 14 functions to ream out any keyseat 16 formed in the wall of the bore 10 during the drilling operation either as the drill string proceeds downwardly or as it is withdrawn. If desired, two or more keyseat wipers may be incorporated in the drill string.

Because the channeled cylindrical middle portion 24 (FIG. 5) and the smooth cylindrical middle portion 32 (FIG. 8) do not have cutting surfaces, the middle guard portion prevents the keyseat wipers 14 or 14' from cutting while in a straight bore 10. In addition, since the drill pipe 12 typically passes through a metal casing, the middle guard portions protect the casing from the cutting edges of the cutting elements 28. Therefore, the casing is protected from damage as the keyseat wiper is drawn through the casing, thus avoiding the possibility of blowout in a pressure well.

Various modifications may be made in the keyseat wiper of the invention without departing from the essentials thereof. For example, the cutting elements may be formed in the keyseat wiper 14 in a spiral fashion, as depicted in above-identified U.S. Pat. No. 2,904,313, while still maintaining the taper illustrated in FIGS. 5 and 8. In addition, if the keyseat wiper is employed in circumstances where reaming of keyseats is normally accomplished by an up-down motion of the drill pipe, the cutting elements 28 may be formed radially, rather than longitudinally, as spaced, annular sections while still maintaining the tapered profile shown in the drawings, so long as the diameter of the largest annular cutting element is no greater than that of the collar 24 or 32. Various other changes may be made to the invention without departing from the spirit thereof or scope of the following claims.

What is claimed is:

1. In a keyseat wiper having a generally cylindrical body, means for connecting the body at its opposite ends in a string of drill pipe, and a plurality of cutting elements spaced apart on the body, the improvement wherein said body comprises:

(a) a cylindrical middle guard portion of greater cross-sectional diameter than the maximum outside diameter of said cutting elements, said guard portion being free of cutting elements, and (b) said cutting elements being tapered between said middle guard portion and the respective ends of said body.

2. The keyseat wiper according to claim 1 in which the surface of said cylindrical middle guard portion is smooth.

3. The keyseat wiper according to claim 1 in which said middle guard portion includes longitudinal channels spaced circumferentially thereabout to permit drilling fluid to pass the keyseat reamer.

4. The keyseat wiper according to claim 1 in which the taper of said cutting elements is constant.

5. The keyseat wiper according to claim 1 in which said cutting elements comprise circumferentially spaced ribs.

6. The keyseat wiper according to claim 5 in which said ribs are dressed with a hard cutting material.

7. The keyseat wiper according to claim 1 wherein said cutting elements comprise spaced annular ribs coaxial with said cylindrical body.

* * * * *